United States Patent [19]

Persson

[11] 4,398,878

[45] Aug. 16, 1983

[54] APPARATUS FOR MAKING SHAPED CONCRETE ARTICLES

[75] Inventor: Bengt Persson, Götene, Sweden

[73] Assignee: Br Perssons Cementvarufabrik AB, Sweden

[21] Appl. No.: 255,124

[22] Filed: Apr. 17, 1981

Related U.S. Application Data

[63] Continuation-in-part of Ser. No. 124,672, Feb. 26, 1980, abandoned.

[30] Foreign Application Priority Data

Mar. 1, 1979 [SE] Sweden ..... 7901846

[51] Int. Cl.[3] ..... B28B 13/00

[52] U.S. Cl. ..... 425/385; 425/397; 425/403; 425/441; 425/442

[58] Field of Search ..... 425/385, 397, 403, 441, 425/442, 451

[56] References Cited

U.S. PATENT DOCUMENTS

| | | | |
|---|---|---|---|
| 2,974,360 | 3/1961 | Giles | 425/385 |
| 2,997,281 | 8/1961 | Remington | 425/456 |
| 3,767,348 | 10/1973 | Perkins | 425/385 |
| 4,247,269 | 1/1981 | Bezhanov | 425/456 |

*Primary Examiner*—John A. Parrish

*Attorney, Agent, or Firm*—Beveridge, De Grandi & Kline

[57] ABSTRACT

An apparatus for adjusting the tolerances regarding the shape and dimensions of an elongated vibrated concrete article made in a mold after removing the article from the mold, making it possible to achieve close tolerances even when using a rather wet concrete composition optimized as regards strength. According to the invention, the article, before hardening, is brought into engagement with one long side of a straight-edge rule for being shaped thereby, the article is pressed on its end surfaces to a predetermined length, and the cross-sectional shape of the article is adjusted to agree with the intended cross-sectional shape while keeping the article in engagement with the rule and pressing it on the end surfaces.

8 Claims, 8 Drawing Figures

APPARATUS FOR MAKING SHAPED CONCRETE ARTICLES

CROSS-REFERENCE TO RELATED APPLICATION

This application is a continuation-in-part of my copending application Ser. No. 124,672 filed Feb. 26, 1980, now abandoned which is relied on herein.

BACKGROUND OF THE INVENTION

The present invention relates to a method and a device or apparatus for carefully adjusting the tolerances of an article made from vibrated concrete in a mold after removal of the article from the mold. The adjusting refers both to dimensions and shape of the article.

When making articles from concrete which must have a high degree of precision, both regarding dimensions and shape, it has been common practice to use a rather dry concrete composition and to stamp or press it in a mold before removing the article therefrom and letting the concrete harden. Though making possible very close tolerances, both regarding dimensions and shape, such a method of manufacture has the drawback that the concrete, due to its low water content, does not have satisfactory strength.

In such cases where the method of manufacture indicated above has not offered a strength high enough, there has up to now not existed any technique useful in practice for making concrete articles with very close tolerances regarding both dimensions and shape. This is due to the fact that concrete having the proportions of its ingredients optimized as regards strength cannot be pressed to form a rigid body in the manner indicated above but instead, to achieve maximum strength, must be vibrated so that the density is increased as much as possible. Even after vibrating, concrete of this composition is rather easily deformable, with the results that such an article removed from the mold can be deformed under influence of gravity, and further that removal from the mold proper often creates difficult problems by causing different kinds of deformation or damage to the article. This is due to the fact that concrete of this quality has a very troublesome tendency of adhering to the surfaces of the mold so that the removal itself often causes strong suction forces to the concrete articles, thereby causing deformation or damage.

SUMMARY OF THE INVENTION

Therefore, the present invention has for its object to provide an apparatus for carefully adjusting tolerances, both regarding dimensions and shape, of an article made from vibrated concrete, after removal of the article from the mold. According to the invention, this is achieved in that one long side of the article, after removal from the mold and before hardening is brought into contact with a straight-edge rule to be shaped thereby; the article is pressed on its end surfaces to a predetermined length; and the cross-sectional shape of the article is adjusted to agree with the intended cross-sectional shape while the article is held in contact with the rule and is being pressed on its end surfaces.

To ensure that sensitive portions of the article, e.g. certain edge or corner portions at the end surfaces of the article, also are given a correct shape, it is according to the invention, provided that certain portions of the end surfaces of the article are pressed to the intended shape after pressing the article to the predetermined length.

To cure, as far as possible, also those shape defects due to deformation of the concrete under influence of gravity and due to impact forces during removal from the mold, it is according to the invention provided that the article, during adjustment of its cross-sectional shape, be rubbed in its longitudial direction, pressure being exerted at least partially on at least one long side of the article remote from the rule.

The invention provides a device for effecting the adjusting of the dimension and shape tolerances. According to the invention, this device or apparatus is characterized in that a support surface for the article is provided which is movable towards and from at least one straight edge rule, in that adjacent each end of the rule there is provided one pressing plate movable in the longitudinal direction of the rule, and in that there is provided a profiled member movable in a direction parallel to the longitudinal direction of the rule, the profiled member being adapted for engagement with at least the side surface of the article remote from the rule.

To achieve the adjustment of the edge or corner portions of the end surfaces of the article, the device is further characterized in that there is movably provided in the proximity of each pressing plate, shaping members engageable with those portions of the end surfaces of the article extending outside the pressing plates for shaping these portions.

To avoid generation of such wave motions in the concrete when contacting the article with the profiled member which have a tendency to deform the shape of the article and to give the profiled member an engagement as uniform as possible with the article, it is, according to the invention, provided that the profiled member comprises surfaces for contacting both an upper surface of the article and the side surface of the article remote from the rule, that the front and rear end portions of the profiled member as seen in the direction of movement are curved out from corresponding surfaces of the article and that the profiled member in proximity to the support surface has a greater length in the direction of movement than is the case at an upper portion for contacting the upper surface of the article.

Therefore, a feature of the invention resides in an apparatus for adjusting dimensions and shape of an elongated article molded from concrete in a mold, wherein said article is molded into the desired shape and after removal from the mold and before hardening is brought into engagement with a straight-edge rule with one of its long sides and is shaped thereby, the article being compressed from the end surfaces to a predetermined length and the cross-sectional shape of the article being adjusted to agree with the desired shape while keeping the article in contact with the rule and pressing it on the end surfaces comprising a support surface for the article which surface is movable towards and from at least one straight-edge rule, and adjacent each end of the rule there is provided a pressing plate movable in the longitudinal direction of the rule and wherein a profiled member is provided movable in a direction parallel to the longitudinal direction of the rule, the profiled member being arranged to contact at least a side surface of the article remote from the rule.

A further feature of the invention is to provide this apparatus with shaping members movably provided adjacent each pressing plate, the pressing plates being engageable with such portions of the end surfaces of the articles as are extending outside the pressing plates for shaping said portions. The apparatus of the invention has a profiled member having portions for engaging both an upper surface of the article and a side surface facing away from the rule, the front and rear edges whereof are curved out from corresponding surfaces of the article and the profiled member adjacent the support surface has a longer length in the direction of its movements than is the case at the portion for engaging the upper surface of the article.

In a more detailed aspect of the invention, the apparatus for adjusting dimensions and shape of an elongated article molded from concrete before hardening the concrete is featured by infeed supports and outfeed supports for carrying the article, the outfeed supports being provided at a lower level than the infeed supports, a feed carriage movable along said infeed and outfeed supports, a table between said infeed and outfeed supports, said table being vertically movable between the levels of the infeed and the outfeed supports, at least one straight-edge rule for contacting and pressing against a side surface of the article when being fed by the feed carriage to a position on the table, pressing plates provided adjacent opposite ends of said rule said pressing plates being movable in the longitudinal direction of the rule for contacting and pressing supports and outfeed supports for carrying the article, the outfeed supports being provided at a lower level than the infeed supports, a feed carriage movable along said infeed and outfeed supports, a table between said infeed and outfeed supports, said table being vertically movable between the levels of the infeed and the outfeed supports, at least one straight-edge rule for contacting and pressing against a side surface of the article when being fed by the feed carriage to a position on the table, pressing plates provided adjacent opposite ends of said rule said pressing plates being movable in the longitudinal direction of the rule for contacting and pressing against opposite end surfaces of the article, and a profiled member arranged to contact at least one side surface of the article remote from the rule said profiled member being displaceable along the article in a direction substantially parallel to the longitudinal direction of the rule.

In greater detail, the apparatus of the invention is further characterized by a feed carriage having a front feeder bar and a rear feeder bar, the front feeder bar being provided at the level of the outfeed supports for displacing the articles therealong, the rear feeder bar being provided at the level of the infeed supports for displacing the articles therealong to said position on the table, the table having on its lower side operating rails for being engaged by operating means on the front feeder bar for lowering the table, said table further having connection with a lifting mechanism for lifting the table when no engagement occurs between the operating means and the operating rails.

BRIEF DESCRIPTION OF THE DRAWINGS

The invention is now to be described more in detail, reference being made to the accompanying drawings. Accordingly.

DETAILED DESCRIPTION OF A PREFERRED EMBODIMENT

Figure 1:
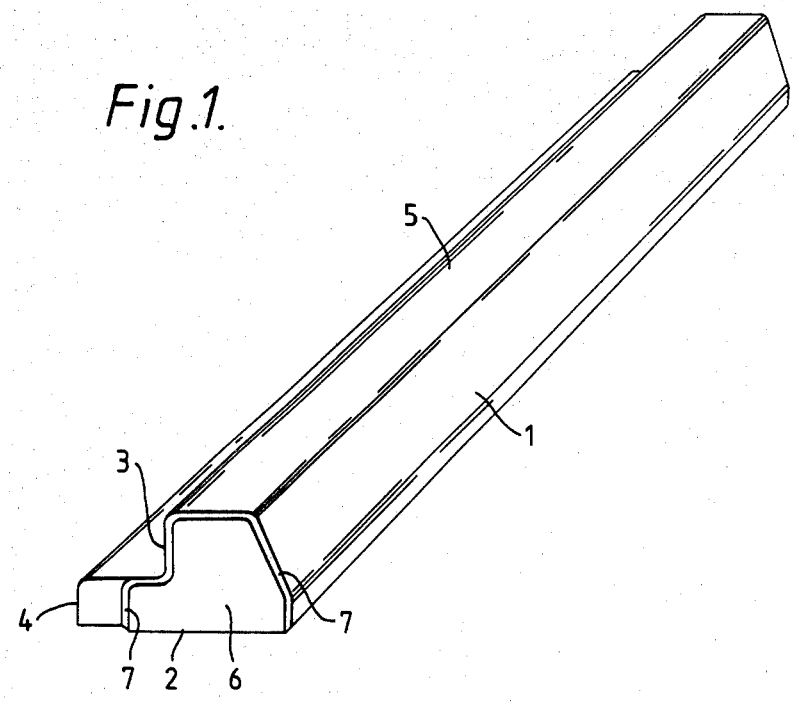
FIG. 1 shows a typical example of a concrete article having dimensions and shape to be adjusted according to the teachings of the invention.

In FIG. 1, there is shown a representative example of a concrete article that either must be accepted with poor tolerances, both regarding shape and dimensions, or must be adjusted in these respects after removal from the mold provided said article is made from a concrete composition optimized as regards strength. Thus, there is in FIG. 1 shows a concrete curbstone which is designed to have its side surface 1 face the driveway while the lower side 2 thereof is supported on the surfacing material of the driveway. The curbstone also comprises two back side surfaces, one upper one 3 and one lower one 4, whereby the portion of the curbstone having the lower side surface 4 is intended to be embedded in a material, e.g. a material which constitutes a lawn, the surfacing material of a sidewalk or the like. This surfacing material preferably has the same level as the upper surface 5 of the curbstone. The indicated use of the curbstone means that essentially only the side surface 1 and the upper surface 5 are visible. Even if such curbstones are made to a high degree of precision both regarding shape and dimensions, it is not certain that the underlying surface will be perfect, and if it is not, the possible consequence is that adjacent end portions of two curbstones are displaced vertically from each other. To hide, as far as possible, such defects, the end surfaces 6 of the curbstone are provided with a bevel 7, which may form, e.g. an angle of 45° to the end surface.

To guarantee a sufficient strength of the curbstone, it is necessary to make it from concrete having proportions optimized as regards strength. This means that the concrete contains a relatively large amount of water, thus making the concrete plastic so that it cannot be pressed to a rigid body and at the same time, giving the concrete a troublesome tendency of adhering to the surfaces of the mold. Under influence of vibrations in the mold concrete of this quality gets a consistency making it possible for the concrete to "flow" so that the mold is completely filled and so that possible bubbles or pockets of air are removed. Immediately after vibration, the concrete regains its semi-rigid, plastic consistency. In this connection it should be noted, however, that the concrete also could be regarded as somewhat thixotropic, which indicates that it becomes flowable under influence of large forces. In order to make it possible to remove the curbstone from the mold after vibrating, it is necessary, due to the adhering, to exert some violence against it. This not only could cause certain deformations per se, but also initiates a removal which is terminated by letting the curbstone fall a short distance (1 to 2 cm) until the lower surface 2 hits a support surface. Due to the thixotropy of the concrete, such an impact causes the curbstone to be deformed as the lower portion thereof has a tendency of deliquescing so that, e.g. the side surface 1 no longer is planar, but, at least at a lower portion, is curved outwardly. This implies that a lower portion of the curbstone could have a width larger than the intended one. In a corresponding manner, the height of the curbstone could be too low. Finally, the above mentioned way of removing the curbstone from the mold results in a risk that the curbstone is bent, making it necessary to check and adjust the straightness of the curbstone.

After removing the curbstone from the mold and having it supported by the support surface, the support surface is displaced in a horizontal direction towards two straight-edge rules having surfaces corresponding to the upper and lower side surfaces of the curbstone 3 and 4, respectively, the support surface being displaced such as distance as to cause sliding between the lower surface 2 of the curbstone and the support surface. In doing so, there is created a proper force between the upper and lower side surfaces 3 and 4 of the curbstone and the corresponding surfaces of the rules. When the movement of the support surface has been stopped, the curbstone is contacting the rules and with the curbstones in this position, the pressing plates are pressed in the longitudinal direction of the rules against the end surfaces 6 of the curbstone so that the curbstone is compressed in its longitudinal direction until a predetermined length is achieved. When this predetermined length is achieved, the pressing plates are kept in their pressing positions and shaping members are caused to contact those portions of the end surfaces 6 extending outside the pressing plates. The shaping members have the purpose of adjusting the shape of the bevels 7 of the end surfaces and of protecting same during the subsequent process. According to the invention, it is sufficient if the bevels 7 at the side surfaces 1 and the upper surfaces 5 are protected, as only these bevels are visible when the curbstone has been laid. However, it is also possible to protect remaining portions of the bevels 7.

When being pressed between the pressing plates and in contact with the straight-edge rules, there remains only to be made an adjustment of the cross-sectional shape of the curbstone and possibly, an improvement of the surface structure, at least on the visible surfaces, i.e., the side surface 1 and the upper surface 5. According to the invention, this is achieved by moving a profiled member in the longitudinal direction of the curbstone and contacting the side surface 1 and the upper surface 5. As the deviation from correct shape normally is greatest at a lower portion of the side surface 1, the concrete in this area would be exposed to a rather high pressure if the profiled member did not have a particularly large contact surface to the curbstone in this area. Such a large pressure cannot correct defects as regards the cross-sectional shape of the curbstone but will only cause formation of a wave in the concrete in front of and behind the profiled member, i.e. there is only caused a more or less elastic deformation of the material of the curbstone. According to the invention, it is essential that the profiled member exerts a uniform pressure (force per unit of area) and further a pressure not so high that there is a risk that the concrete becomes more or less "flowing". To even better eliminate the risk that the curbstone is exposed to a local excessive pressure, the front and rear edge portions of the profiled member are curved somewhat out from the curbstone, whereby the force against the material of the curbstone is applied slowly and gradually so that no peak stresses are created and certainly no material is cut away from the curbstone. As the profiled member is brought along the curbstone one or more times, the curbstone is exposed to forces trying to restore the intended cross-sectional shape. As these forces generated by the profiled member, at least at some distance inside the curbstone, could be regarded as small, they do not cause such large and quick movements in the concrete as could possibly alter the concrete to a more flowable condition. Thus, the adjustment of the cross-sectional shape of the curbstone, at least regarding the major part thereof, possibly excluding the surface layer in contact with the profiled member, could be regarded as a more or less static pressing process with a uniform and low pressure.

The thin surface layer in direct contact with the profiled member is exposed to a much more intense agitation. Therefore, this surface layer will be converted to a flowable condition and a rather fluid, fine suspension of water and concrete is separated. This fluid suspension enters possible pores in the treated surfaces of the curbstone so that they are given a very fine and dense surface structure.

When the adjustment of the cross-sectional shape of the curbstone and the improvement of the surface structure, at least on the upper surface 5 and the side surface 1, is finished, the profiled member is returned to its rest position. Then the support surface is lowered, while keeping the pressing plates in their pressing positions and the shaping members in their positions engaging the bevels 7. In doing so, a pure sliding action occurs in the plane of the end surfaces between the pressing plates and the end surfaces 6. At the same time, a pure sliding action occurs between the rules and the two back side surfaces 3 and 4. This sliding takes place in the plane of the surfaces in question. Further, there is achieved an action rather similar to the smoothing action performed by the profiled member on the side surface 1 and the upper surface 5. As soon as the curbstone is free from engagement with the rules and the pressing plates, the curbstone is removed, supported on the support surface, and is transferred to a storing room for hardening of the concrete. In this connection, the pressing plates and the shaping members are returned to their initial positions so that the cycle of operation could be repeated with a new curbstone.

Figure 2:
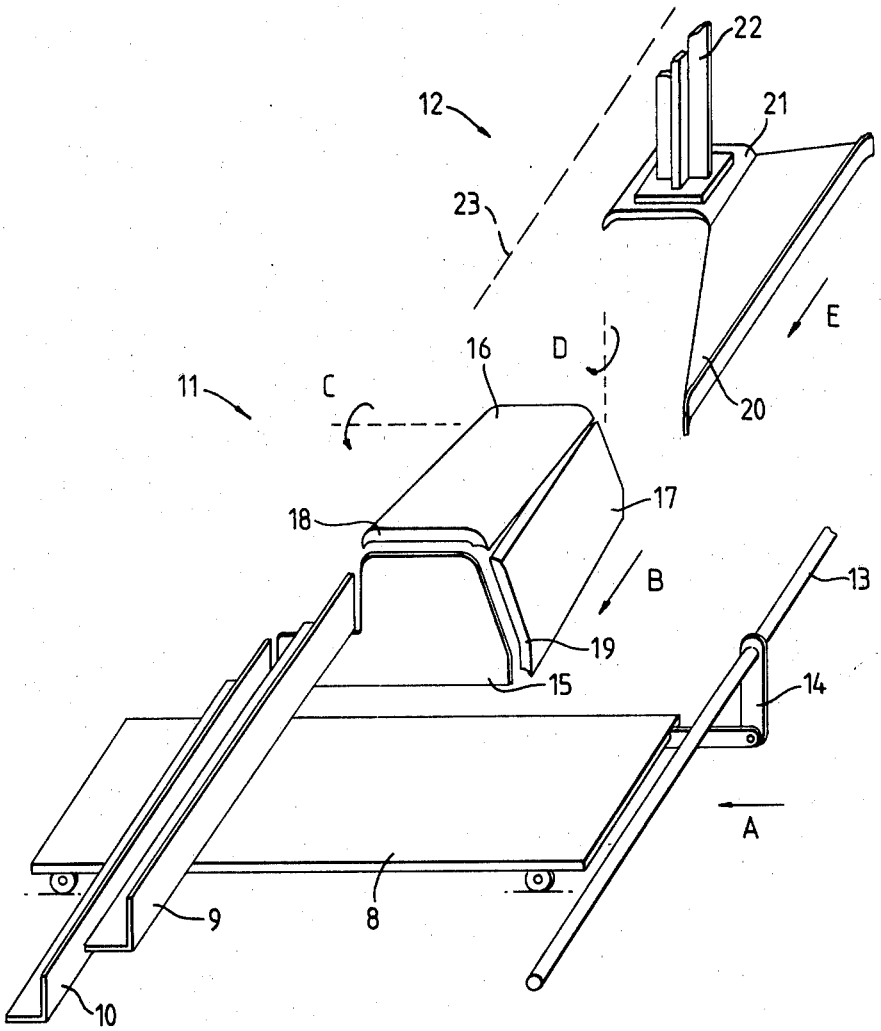
FIG. 2 shows schematically and for the sake of clarity, only one-half of a device in accordance with the invention.

In FIG. 2, there is shown schematically and for the sake of clarity only one-half of a device for carrying the above adjusting into effect. The device comprises a table 8 movable in the direction of arrow A, straight-edge rules 9 and 10, a device 11 for treating the end portion of the curbstone, and a second device 12 for adjusting the cross-sectional shape. Apart from the components mentioned above, the inventive device comprises in practice a second table and a second device for treating the opposing end portion of the curbstone. Further, the rules 9 and 10 have a length considerably larger than that shown on the drawing. The second table (not shown on the drawing) is arranged on the same level as the table 8 shown on the drawing and is movable together therewith. The second device for treating the opposing end portion of the curbstone is located in the same manner relative to the second table as is the first device 11 is relative to the table 8 and the end portions of the rules 9 and 10.

As mentioned above, the table 8 is displaceable in a horizontal direction in the direction of arrow A. This could be achieved by supporting the table on rollers or the like on a support surface of any suitable configuration. The movements of the table are generated by having it connected to a revolving shaft 13 via a linkage 14. Also, the second table is connected to this shaft, whereby the two tables are movable in synchronism in the same horizontal plane. The two tables have the purpose of carrying a support pad or the like, the pad carrying the curbstone when being introduced into the device. In doing so, the curbstone is brought to a position where the end surface is substantially aligned with a pressing plate 15 forming a part of the device 11 and being movable in the direction of arrow B. Further, the curbstone is located in such a way that the upper and lower side surfaces 3 nd 4, respectively are positioned in front of the two straight-edge rules 9 and 10 respectively. When the tables 8 are displaced in the direction of arrow A, the side surfaces 3 and 4 are pressed against the rules 9 and 10 until a sliding action occurs between the tables and the support pad.

The device 11 for treating the end portion of the curbstone comprises apart from the pressing plate 15, an upper shaping member 16 and side shaping member 17. The end edges of these members facing the table are designed in such a way as to correspond to the bevels 7 at the upper surface 5 and the side surface 1 of the curbstone. Therefore, the end surfaces 18 and 19 of the shaping members 16 and 17, respectively are arranged at an angle of 45°, both to the longitudinal directions of the shaping members and to the pressing plate 15. The upper shaping member 16 is pivotable about an axis indicated at arrow C, and the side shaping member 17 is pivotable about an axis indicated at arrow D. By pivoting the shaping members in the directions of the arrows, the end surfaces 18 and 19 thereof can be brought to positions (not shown) close to the corresponding edges of the pressing plate 15. Thus, the device 11 will engage both the end surface 6 proper and the bevels 7 of the curbstone. The arrangement of the device 11 (and also the second device for engaging the opposing end portion of the curbstone) is such that the pressing plate 15 is moved towards the end surface 6 of the curbstone and then the shaping members 16 and 17 are pivoted in the directions of arrows C and D respectively to engage the bevels 7 of the curbstone. In this position, the end portions of the shaping members 16 and 17 remote from the curbstone preferably are somewhat displaced towards the center line of the curbstone so that the cross-sectional area defined by said end portions is slightly smaller than the cross sectional area of the curbstone. By this arrangement, the shaping members 16 and 17 form ramp surfaces preventing an unintended engagement between the shaping members and the profile adjustment device 12 when put in motion in the direction of arrow E.

The profile adjustment device 12 comprises at its lower end a rubbing shoe having one side surface 20 for contacting the side surface 1 of the curbstone and an upper surface 21 for contacting the upper surface 5 of the curbstone. The junction of the surfaces 20 and 21 is curved in the same way as is the edge portion between the upper surface 5 and the side surface 1 of the curbstone. Further, the rubbing shoe comprises, at its front and rear ends, portions which are curved out from the curbstone. At an upper portion thereof, the rubbing shoe is fastened to a carrier 22 which is in turn displaceably fastened to a guide means indicated in FIG. 2 by the broken line 23. The guide means 23 has such a length that the rubbing shoe is displaceable along the whole length of the curbstone. The details of the guide means 23 and the upper end of the carrier 22 are not of any importance to the invention as long as an adequate guiding is provided to the side surface 20 and the upper surface 21 of the rubbing shoe. Finally, the carrier 22 is connected to a drive means (not shown) for displacing the rubbing shoe along the guide means 23.

From FIG. 2, it is clearly seen that the side surface 20 of the rubbing shoe has a much greater length in the direction of movements at its lower end than is the case at its upper end. The reason is that the curbstone normally has the largest deviations from the correct shape at its bottom which would result in an undesirably large pressure from the lower portion of the rubbing shoe if the rubbing shoe had the same length along its whole height. By the configuration shown, there is instead created a substantially uniform pressure from the whole surface of the rubbing shoe against the curbstone, whereby there is no risk of wave motions or displacements of the kind mentioned above in the material of the curbstone. By this configuration, the lower portions of the rubbing shoe will counteract the forces created by the upper portions and thereby avoid such a downward displacement of shape defects which were originally present at the upper portions of the curbstone as would have caused or aggravated the formation of waves in front of and behind the lower portion of the rubbing shoe. Thus, the increased length of the rubbing shoe prevents the concrete from bellying in front of and behind the rubbing shoe.

Figure 3:
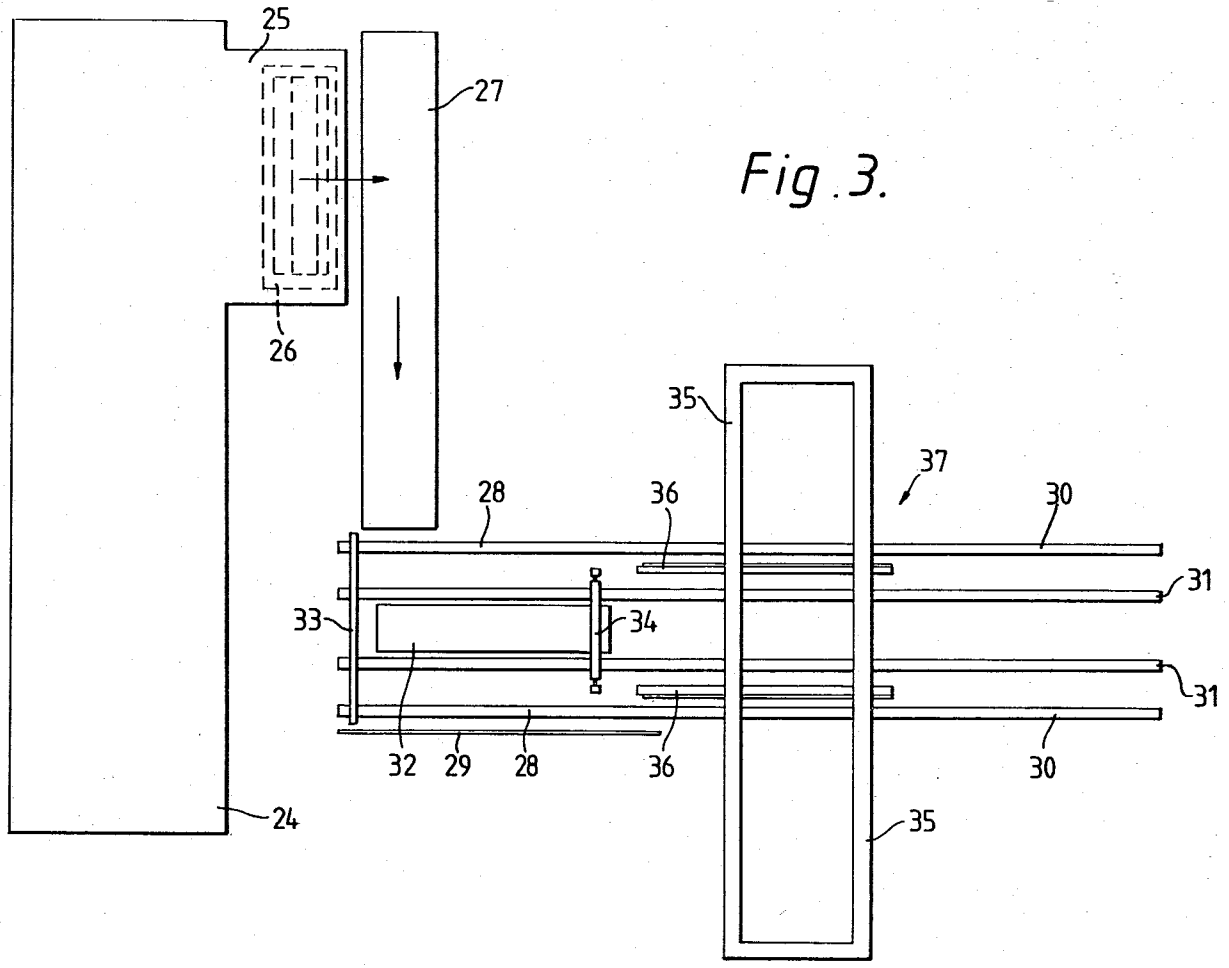
FIG. 3 is a diagrammatic top plan view of a plant for manufacturing curbstones in accordance with the present invention.

In FIG. 3, there is shown a diagrammatic top plan view of a plant for manufacturing the present curbstone. In this figure, a molding machine 24 for molding the curbstone and is provided with on exit 22 therefrom. From exit 25, the curbstone supported on the support pad 26 is transferred to a conveyor 27 for conveying the support pad and the curbstone thereon to the apparatus of the invention for adjusting the dimensions and shape of the curbstone. Support pad 26 may be formed of any suitable rigid material capable of supporting the curbstone during its transit through the apparatus.

As seen in FIG. 3, the apparatus comprises two horizontal infeed supports 28 provided in parallel for supporting the support pad 26 being fed through the machine, two outfeed supports 30 also for supporting the support pad and the curbstone after having been treated, and four guide rails 31 (only two of which are shown in FIG. 3) for guiding a feed carriage 32 having a front feeder bar 34 and a rear feeder bar 33 for feeding the support pad 26 along the infeed and outfeed supports.

At the treating zone 37 of the apparatus, there is provided a guide frame 35 on which a carriage 38 (FIG. 4) is supported and guided, the carriage having depending therefrom, carrier 22 (FIG. 2) of the device 12 for adjusting the cross-sectional shape of the curbstone.

The outfeed guides 30 are at a lower level than the infeed guides 28. For operating a mechanism for lowering the support pad from the infeed guides to the outfeed guides, there are provided on the lower sides of tables 8 (FIG. 2) operating rails 36 for co-operating with rollers 39 on the front feeder bar 34.

Figure 4:
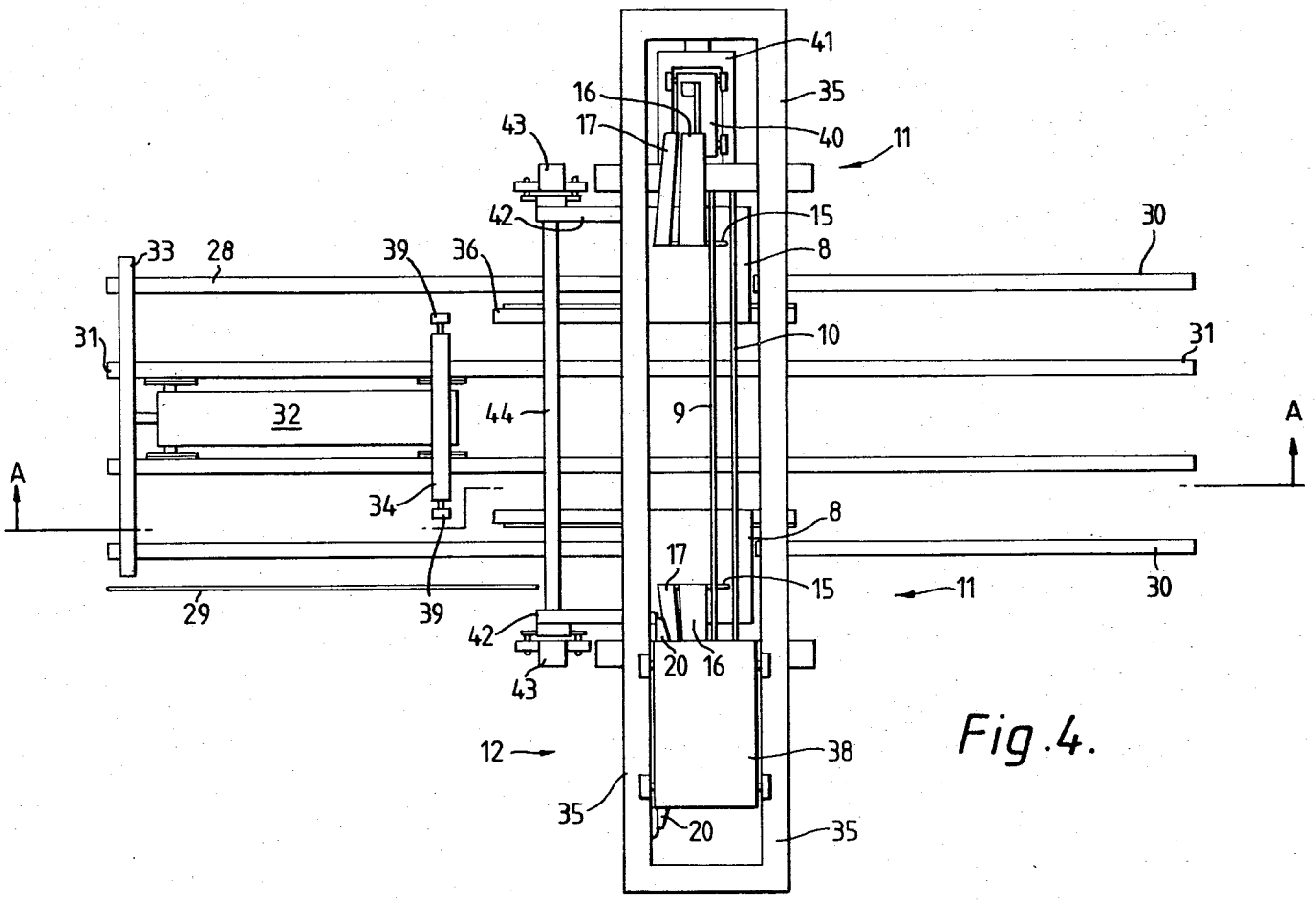
FIG. 4 is a more detailed top plan view of the apparatus of the invention.

In FIG. 4, there is shown a more detailed top plan view of the apparatus of the invention. In this figure, there are also inserted the reference numerals of those details shown in FIG. 2.

The two devices 11 are mounted as units on carriages 40 (only one of which is shown in FIG. 4) supported and guided on guide frames 41. For operating the carriage 40 and the shaping members 16 and 17, there are provided pneumatic cylinders (not shown).

The carriage 38 is drivable along the guide frame under influence of a drive mechanism comprising a reversible electric motor and drive chain running on two sprockets, the chain being connected to carriage 38.

FIGS. 5 to 8 show vertical cross-sectional views substantially along line A—S in FIG. 4. As mentioned above, infeed supports 28 are at a higher level than are outfeed supports 30. The two tables 8 are movable between these levels and are supported on carriages 42 guided along vertical posts 43. The two carriages 42 are connected to each other by means of cross bars 44 to form a rigid unit so that the two tables 8 are level with each other and are moved in synchronism. The carriages 42 are, via linkage 45, connected to counter weights (not shown) having the purpose of keeping the tables in their positions level with the infeed supports 28 when no engagement occurs between rollers 39 and operating rails 36.

Figure 5:
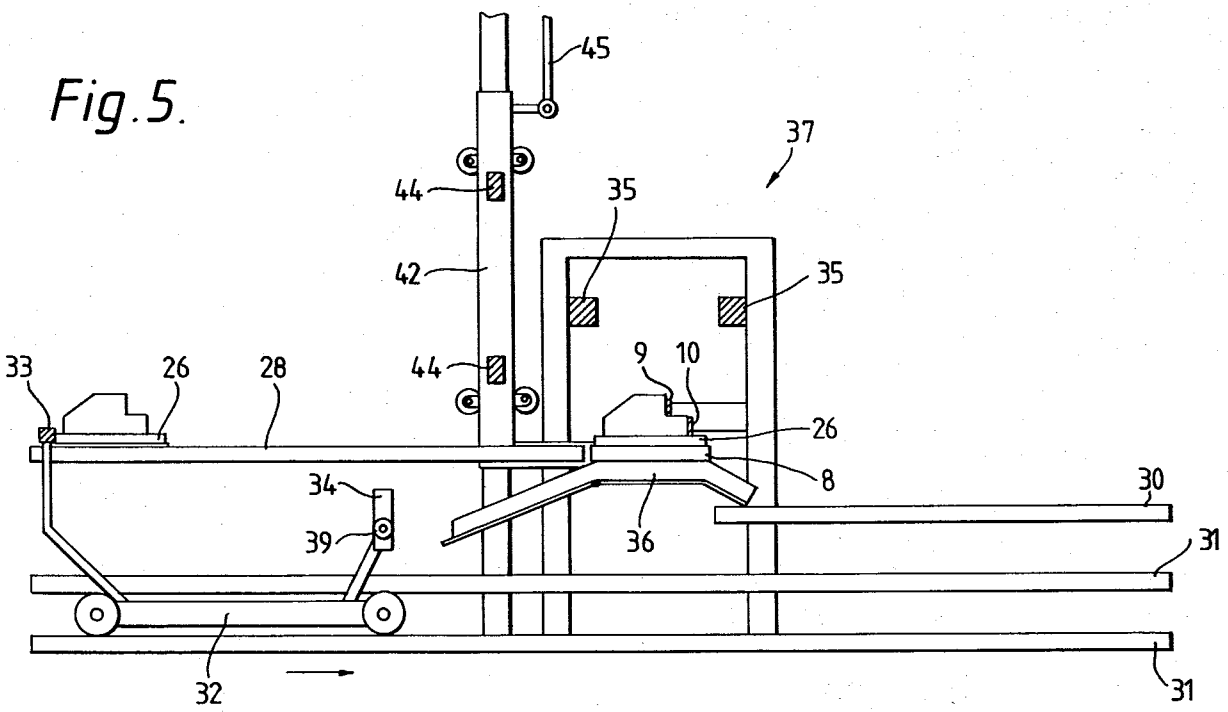
FIGS. 5 through 8 show vertical cross-sectional views substantially along line A—A in FIG. 4.

In FIG. 5, the feed carriage 32 is in its initial position for the cycle and a support pad 26 carrying a curbstone has been conveyed (by means of conveyor 27 of FIG. 3) to the position shown on infeed supports 28. In this position one end of support pad 26 engages the abuttment 29.

When feed carriage 32 moves to the right in FIG. 5 in the direction of the arrow, pad 26 slides on the supports 28, and the rollers 39 engage the operating rails 36 for lowering the two tables 8. During this lowering, the above-mentioned sliding action takes place between the straight-edge rules 9 and 10 and the surfaces 3 and 4 of the curbstone.

Figure 6:
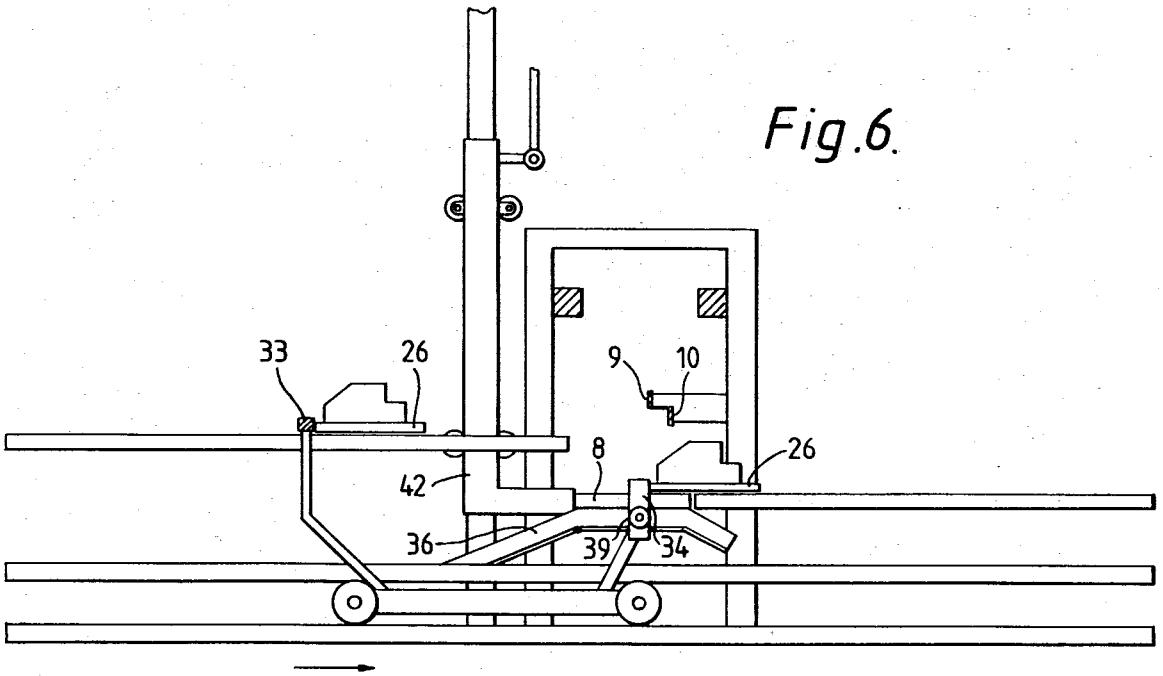

In FIG. 6, the tables 8 have reached their lower positions, the curbstone is free of the straight-edge rules 9 and 10, and the support pad 26 is being fed from the tables to the outfeed supports 30.

When the feed carriage 32 is moved further to the right in the direction of the arrow, the rollers 39 no longer engage the operating rails 36 and the tables 8 immediately return to their upper positions under influence of counter weights (not shown) and are ready to receive the next curbstone as shown.

Figure 7:
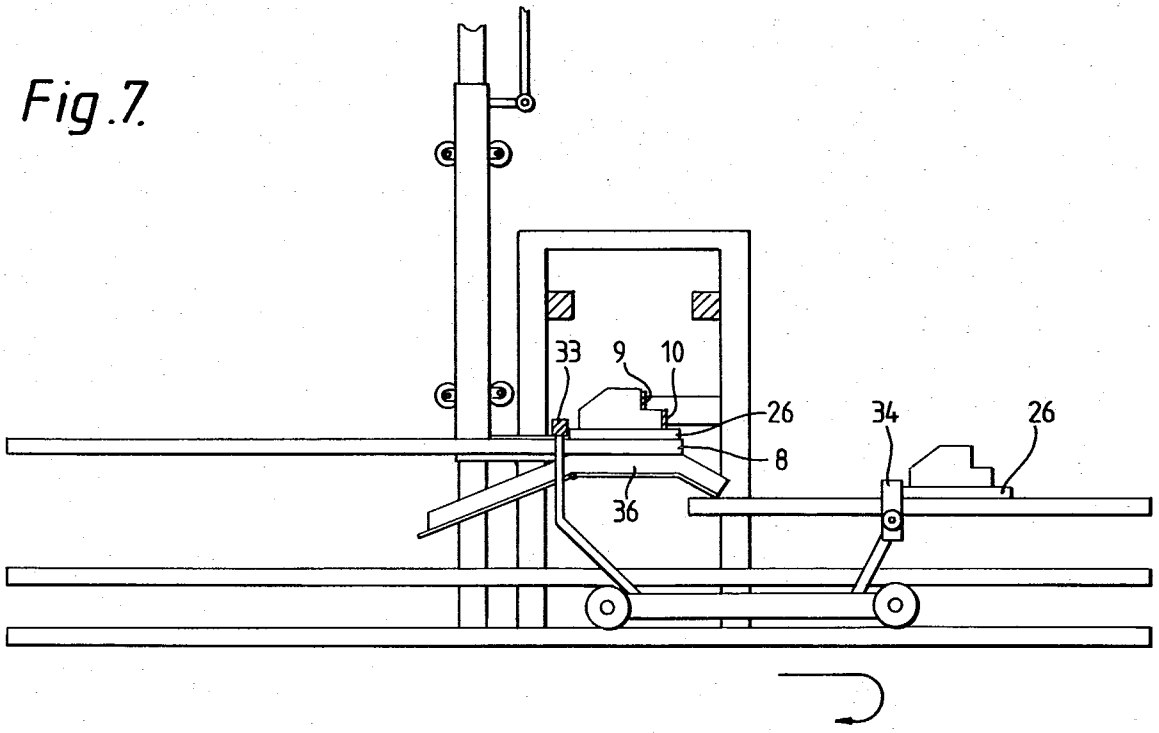

In FIG. 7, the feed carriage 32 has reached its right end position and the rear feeder bar 33 has fed the pad 26 to such a position on the tables 8 that the second curbstone is abutting the rules 9 and 10 and the above-mentioned sliding action has taken place between the pad and the bottom surface of the first curbstone.

From the position of FIG. 7, the feed carriage 32 is returned to the left end position. During this back travel, the treatment of the curbstone on the tables 8 is performed.

Figure 8:
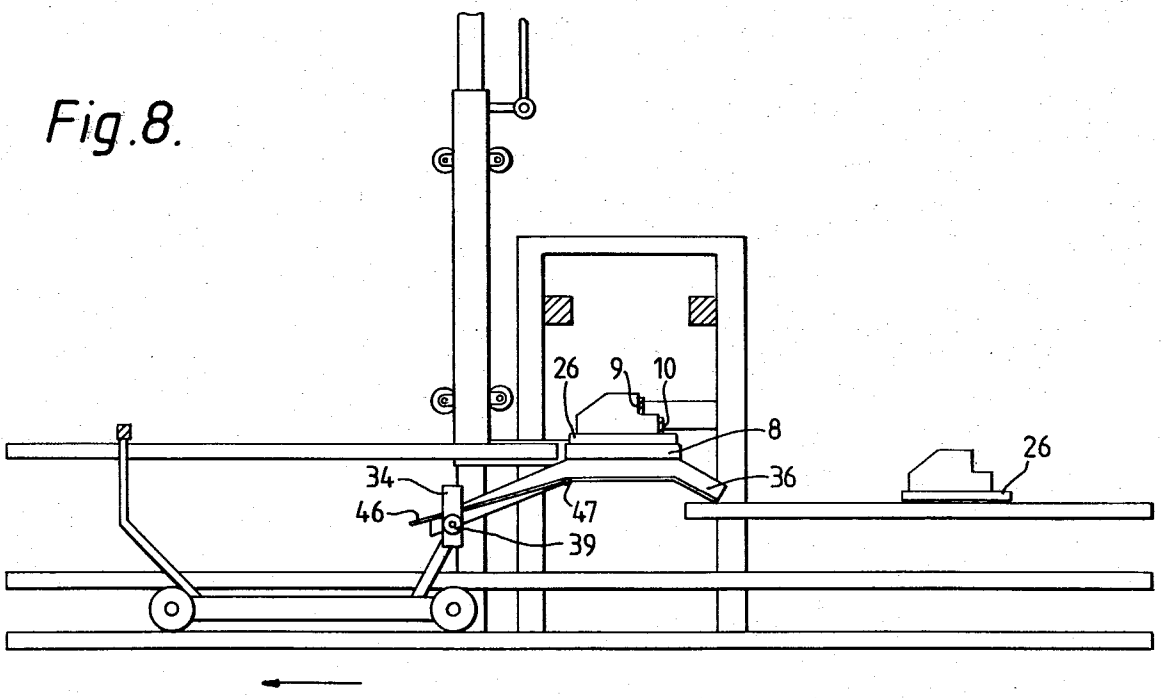

From FIG. 8 it is evident that the operating rails 36 have lower flaps 46 pivoted at 47 for allowing them to be lifted by the rollers 39 instead of forcing the tables upwardly beyond their upper positions. The lower positions of these flaps are defined by suitable abuttments.

When the carriage 32 has reached its left end position, a new pad 26 and a curbstone is conveyed to a position (shown in FIG. 5) in front of feeder bar 33 and the cycle is repeated.

The invention can be modified within the scope of the following claims. Thus, it is possible to provide openings in the pressing plates 15 at suitable locations therein. Such openings have the purpose of making it possible to provide the end surfaces 6 of the curbstone with projections and corresponding depressions for locking together adjacent end portions of curbstones when laid.

In a further modification of the invention the curbstone need not have the shape of FIG. 1. Instead the side surface 3 can extend to the lower surface 2. In this embodiment there is no need for more than one rule 9.

I claim:

1. An apparatus for adjusting the dimensions and shape of an elongated article molded from concrete in a mold, comprising a support surface for the article, a straight-edge rule, means for moving said support surface towards and from said straight-edge rule, a first and a second pressing plate adjacent respectively a first and a second end of said straight-edge rule and movable in the longitudinal direction of the rule, and a member profiled to the shape desired of the finished concrete article, movable in a direction parallel to the longitudinal direction of the rule, and arranged to contact at least a side surface of the article remote from the rule.

2. The apparatus according to claim 1, further comprising shaping members movably positioned adjacent each pressing plate and engageable with such portions of the end surfaces of the articles as are extending outside the pressing plates for shaping said portions.

3. The apparatus according to claim 2, wherein the profiled member has portions for engaging both an upper surface of the article and a side surface facing away from the rule, has front and rear edges curved out to be remote from corresponding surfaces of the article, and adjacent the support surface has a greater length in the direction of movements than adjacent the article upper surface.

4. An apparatus for adjusting the dimensions and shape of an elongated article molded from concrete before the article has hardened comprising a support surface, a straight-edge rule, means for moving one of said support surface and said straight-edge rule relative to the other to bring said support surface and said straight-edge rule to an abutting relationship, pressing plates adjacent opposite ends of said rule, means for moving said pressing plates into contact with opposite end surfaces of the article, a profiled member, and means for moving said profiled member in a direction substantially parallel with the longitudinal direction of the rule and in contact with at least one side surface of the article remote from said rule.

5. The apparatus according to claim 4 further comprising shaping members movably positioned adjacent each pressing plate and engageable with such portions of the end surfaces of the articles as are extending outside the pressing plates for shaping said portions.

6. The apparatus according to claim 4 wherein the profiled member has portions for engaging both an upper surface of the article and a side surface facing away from the rule, has front and rear edges curved out to be remote from corresponding surfaces of the article, and adjacent the support surface has a greater length in the direction of movement than adjacent the article upper surface.

7. An apparatus for adjusting the dimensions and shape of an elongated article molded from concrete before hardening of the concrete, comprising infeed supports and outfeed supports for carrying the article, the outfeed supports being at a lower level than the infeed supports; a feed carriage movable along said infeed and outfeed supports; a table between said infeed and outfeed supports, said table being vertically movable between the levels of the infeed and the outfeed supports; at least one straight-edge rule for contacting and pressing against a side surface of the article when the article is being fed by the feed carriage to a position on the table; pressing plates provided adjacent opposite ends of said rule; means for moving said pressing plates in the longitudinal direction of the rule for contacting and pressing against opposite end surfaces of the article; a profiled member arranged to contact at least one side surface of the article remote from the rule; and means for moving said profiled member along the article in a direction substantially parallel to the longitudinal direction of the rule.

8. The apparatus according to claim 7 wherein said feed carriage has a front feeder bar and a rear feeder bar, the front feeder bar being provided at the level of the outfeed supports for displacing the articles therealong, the rear feeder bar being provided at the level of the infeed supports for displacing the articles therealong to said position on the table, the table having on its lower side operating rails, the front feeder bar having operating means engaging with said operating rails for lowering the table, said apparatus further comprising a lifting mechanism cooperating with said table for lifting the table when no engagement occurs between the operating means and the operating rails.

* * * * *